US011571713B2

(12) United States Patent
Hashimoto et al.

(10) Patent No.: US 11,571,713 B2
(45) Date of Patent: Feb. 7, 2023

(54) VIBRATION STRUCTURE AND ELECTRONIC DEVICE

(71) Applicant: Murata Manufacturing Co., Ltd., Nagaokakyo (JP)

(72) Inventors: Junichi Hashimoto, Nagaokakyo (JP); Shozo Otera, Nagaokakyo (JP); Jun Endo, Nagaokakyo (JP); Toru Tominaga, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 393 days.

(21) Appl. No.: 16/857,605

(22) Filed: Apr. 24, 2020

(65) Prior Publication Data

US 2020/0246830 A1 Aug. 6, 2020

Related U.S. Application Data

(63) Continuation of application No. PCT/JP2019/045270, filed on Nov. 19, 2019.

(30) Foreign Application Priority Data

Jan. 21, 2019 (JP) ..... JP2019-007852

(51) Int. Cl.
*B06B 1/06* (2006.01)

(52) U.S. Cl.
CPC ..... *B06B 1/0688* (2013.01)

(58) Field of Classification Search
CPC ..... B06B 1/0688
USPC ..... 310/334
See application file for complete search history.

(56) References Cited

U.S. PATENT DOCUMENTS

2019/0155391 A1 5/2019 Hashimoto et al.
2020/0343439 A1* 10/2020 Hashimoto ..... H01L 41/0986

FOREIGN PATENT DOCUMENTS

| | | | |
|---|---|---|---|
| JP | H03124645 | A | 5/1991 |
| JP | 2001179180 | A | 7/2001 |
| JP | 2009142045 | A | 6/2009 |
| JP | 2012137971 | A | 7/2012 |
| JP | 2016071451 | A | 5/2016 |

(Continued)

OTHER PUBLICATIONS

International Search Report Issued for PCT/JP2019/045270, dated Feb. 4, 2020.

(Continued)

*Primary Examiner* — Daniel L Murphy
(74) *Attorney, Agent, or Firm* — ArentFox Schiff LLP

(57) ABSTRACT

A vibration structure that includes a film constructed to deform in a plane direction as voltage is applied thereto, a frame-shaped member, a vibration portion surrounded by the frame-shaped member in a plan view of the vibration structure, a support portion connecting the vibration portion and the frame-shaped member and supporting the vibration portion within the frame-shaped member, a first connection member that connects the film and the frame-shaped member, and a second connection member that connects the film to the vibration portion such that the vibration portion vibrates in the plane direction when the film is deformed in the plane direction. The support portion is disposed at a position closer to a center of gravity of the vibration portion than an end portion of the vibration portion when viewed in the plan view.

13 Claims, 4 Drawing Sheets

(56) References Cited

FOREIGN PATENT DOCUMENTS

| | | | |
|---|---|---|---|
| WO | 2014141336 | A1 | 9/2014 |
| WO | 2019013164 | A1 | 1/2019 |

OTHER PUBLICATIONS

Written Opinion of the International Searching Authority issued for PCT/JP2019/045270, dated Feb. 4, 2020.

* cited by examiner

VIBRATION STRUCTURE AND ELECTRONIC DEVICE

CROSS REFERENCE TO RELATED APPLICATIONS

The present application is a continuation of International application No. PCT/JP2019/045270, filed Nov. 19, 2019, which claims priority to Japanese Patent Application No. 2019-007852, filed Jan. 21, 2019, the entire contents of each of which are incorporated herein by reference.

FIELD OF THE INVENTION

The present invention relates to a vibration structure and an electronic device including the vibration structure.

BACKGROUND OF THE INVENTION

For example, Japanese Patent Application Laid-Open No. 2012-137971 (Patent Document 1) discloses a configuration in which a vibration motor is disposed in an end portion of a touch panel and the entire touch panel is vibrated with a substantially uniform vibration amount.

Patent Document 1: Japanese Patent Application Laid-Open No. 2012-137971

SUMMARY OF THE INVENTION

However, in a case where a vibration structure includes a vibration portion that vibrates and a plurality of support portions, and the vibration portion is supported by the support portions, the vibration portion may bend between the support portions due to its own weight.

Since the bending occurs in a direction perpendicular to the vibration portion, a bending mode, which is vibration in the direction, is likely to occur.

In view of the above, an object of the present invention is to provide a vibration structure that suppresses the occurrence of the bending mode of the vibration portion, and an electronic device including the vibration structure.

A vibration structure according to the present invention includes a film constructed to deform in a plane direction as a voltage is applied thereto, a frame-shaped member, a vibration portion surrounded by the frame-shaped member in a plan view of the vibration structure, a support portion connecting the vibration portion and the frame-shaped member, and supporting the vibration portion within the frame-shaped member, a first connection member that connects the film to the frame-shaped member, and a second connection member that connects the film to the vibration portion such that the vibration portion vibrates in the plane direction when the film is deformed in the plane direction. The support portion is disposed at a position closer to the center of gravity of the vibration portion than an end portion of the vibration portion when viewed in the plan view.

An electronic device according to the present invention includes the vibration structure according to the present invention, a display screen unit, and a housing.

With the above-described vibration structure and the electronic device including the vibration structure, the bending mode of the vibration portion can be suppressed.

DETAILED DESCRIPTION OF THE INVENTION

Figure 1A:
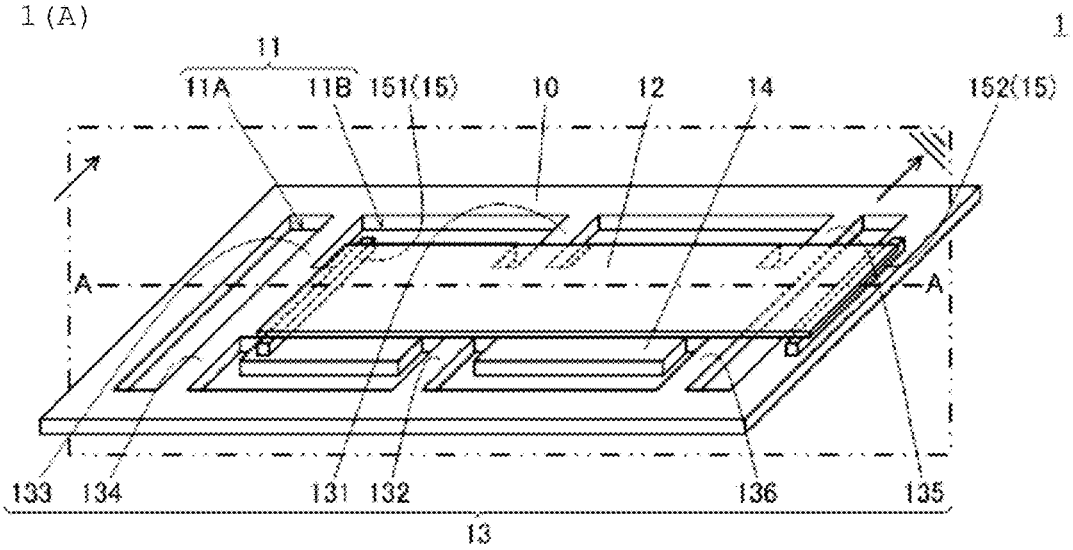
FIG. 1(A) is a perspective view of a vibration structure 1.
Figure 1B:
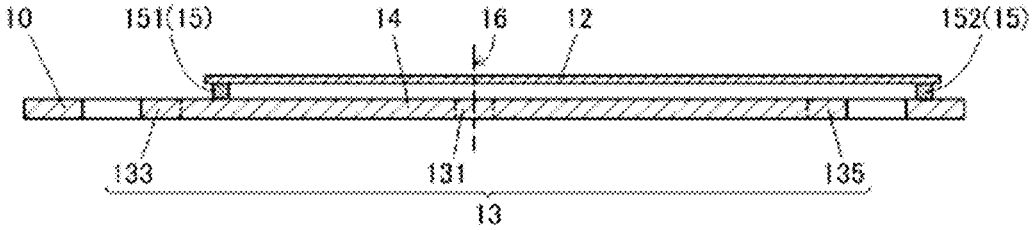
FIG. 1(B) is a cross-sectional view of the vibration structure 1 along A-A.

FIG. 1(A) is a perspective view of a vibration structure 1 according to a first embodiment of the present invention. FIG. 1(B) is a cross-sectional view of the vibration structure 1 along A-A in FIG. 1(A).

The vibration structure 1 includes a frame-shaped member 10, a piezoelectric film 12, a support portion 13 having a first support portion 131, a second support portion 132, a third support portion 133, a fourth support portion 134, a fifth support portion 135, and a sixth support portion 136, a vibration portion 14, and a connection member 15 having a first connection member 151 and a second connection member 152.

The frame-shaped member 10 has a rectangular shape in a plan view, and has a region 11 surrounded by the frame-shaped member 10. In the region surrounded by the frame-shaped member 10, the support portion 13 and the vibration portion 14 are disposed. The region surrounded by the frame-shaped member 10 has two first openings 11A disposed at opposed ends in a longitudinal direction of the frame-shaped member 10, and two second openings 11B disposed at opposed ends in a lateral direction, and which are formed by the support portion 13 and the vibration portion 14. The first opening 11A has a rectangular shape, and has a shape that is longer along the lateral direction of the frame-shaped member 10. The second opening 11B is a rectangular opening that is longer along the longitudinal direction of the frame-shaped member 10. The opposed ends in the longitudinal direction of the second opening 11B extend toward a center axis (line A-A in the diagram) of the frame-shaped member 10.

The vibration portion 14 has a rectangular shape in a plan view, and is disposed in a region 11 surrounded by the frame-shaped member 10. An area of the vibration portion 14 is smaller than an area of the region 11 surrounded by the frame-shaped member 10.

The support portion 13 connects the vibration portion 14 and the frame-shaped member 10 so that the vibration portion 14 is supported by the frame-shaped member 10. The support portion 13 includes the first support portion 131, the second support portion 132, the third support portion 133, the fourth support portion 134, the fifth support portion 135, and the sixth support portion 136. The first support portion 131 and the second support portion 132 are provided so as to face each other with the vibration portion 14 interposed therebetween, and are provided close to a center of gravity 16 of the vibration portion 14. The third support portion 133 and the fourth support portion 134 are provided so as to face each other with the vibration portion 14 interposed therebetween, and are provided in a first end portion in the longitudinal direction of the vibration portion 14. The fifth support portion 135 and the sixth support portion 136 are provided so as to face each other via the vibration portion 14 interposed therebetween, and are provided in a second end portion opposite to the first end portion in the longitudinal direction where the third support portion and the fourth support portion are provided. Further, the piezoelectric film 12 expands and contracts along the longitudinal direction of the vibration portion 14. That is, on one side of the vibration portion 14, the first support portion 131, the third support portion 133, and the fifth support portion 135 are disposed side by side in the direction in which the piezoelectric film 12 expands and contracts, and, on the other side of the vibration portion 14, the second support portion 132, the fourth support portion 134, and the sixth support portion 136 are disposed side by side in the direction in which the piezoelectric film 12 expands and contracts. In this example, the support portion 13 has a rectangular shape that is longer along the lateral direction of the frame-shaped member 10 that is orthogonal to the direction in which the piezoelectric film 12 expands and contracts, and holds the vibration portion 14 at both end portions in the longitudinal direction of the vibration portion 14.

In this example, the frame-shaped member 10, the vibration portion 14, and the support portion 13 are formed of the same material (for example, acrylic resin, PET, polycarbonate (PC), glass epoxy, FRP, metal, glass, or the like). That is, the frame-shaped member 10, the vibration portion 14, and the support portion 13 are formed by punching a single rectangular plate along shapes of the first opening 11A and the second opening 11B. The frame-shaped member 10, the vibration portion 14, and the support portion 13 may be different materials, but can be easily manufactured by being formed of the same material. Alternatively, as the frame-shaped member 10, the vibration portion 14, and the support portion 13 are formed of the same material, another material (a material with creep deterioration) such as rubber does not need to be used for supporting the vibration portion 14, and the vibration portion 14 can be stably held for a long time. Further, in a case where they are formed of the same material and punching is performed, the natural vibration periods of a plurality of the support portions 13 are exactly the same, so that the vibration variation of the vibration portion 14 when the vibration portion 14 is vibrated can be reduced. However, in the present invention, these members do not need to be formed of the same material. For example, in a case where different materials are used for a plurality of the support portions 13, the movement of the vibration portion 14 can be adjusted. For example, when a material having a high elastic coefficient such as rubber is used for the support portion 13, the magnitude of voltage applied to the piezoelectric film 12 can be reduced.

The piezoelectric film 12 is connected to the frame-shaped member 10 and the vibration portion 14. The piezoelectric film 12 is a film that deforms in a plane direction when voltage is applied. The piezoelectric film 12 has a rectangular shape that is longer along the longitudinal direction of the frame-shaped member 10 in the plan view. The piezoelectric film 12 is made from, for example, polyvinylidene fluoride (PVDF). Alternatively, the piezoelectric film 12 may be made from a chiral polymer. As the chiral polymer, for example, L-type polylactic acid (PLLA) or D-type polylactic acid (PDLA) is used.

When PVDF is used for the piezoelectric film 12, since the PVDF has water resistance, an electronic device including the vibration member in this example can be vibrated similarly under any humidity environment.

Further, in a case where PLLA is used for the piezoelectric film 12, since PLLA is a highly transmissive material, if an electrode added to PLLA and the vibration portion are made from a transparent material, an internal situation of the equipment can be visually recognized. Accordingly, the equipment can be easily manufactured. Further, since PLLA has no pyroelectricity, similar vibration can be caused under any temperature environment.

In a case where the piezoelectric film 12 is configured with PLLA, the piezoelectric film 12 has piezoelectricity by being cut so that each outer peripheral side is approximately 45° with respect to a stretching direction.

A first end in the longitudinal direction of the piezoelectric film 12 is connected to a first end in the longitudinal direction of the frame-shaped member 10. A second end of the piezoelectric film 12 is connected to a second end in a longitudinal direction of the vibration portion 14.

As shown in FIG. 1(B), the piezoelectric film 12 is connected to the frame-shaped member 10 and the vibration portion 14 with the connection member 15 interposed therebetween. The piezoelectric film 12 is connected to the frame-shaped member 10 with the second connection member 152 interposed therebetween. Further, the piezoelectric film 12 is connected to the vibration portion 14 with the first connection member 151 interposed therebetween. The connection member 15 has a rectangular shape that is longer along the lateral direction of the frame-shaped member 10 in the plan view. The connection member 15 has a certain thickness, and connects the piezoelectric film 12 and the vibration portion 14 at positions separated from each other to some extent, so that the piezoelectric film 12 does not contact the vibration portion 14. In this manner, an electrode (not shown) provided on both main surfaces of the piezoelectric film 12 does not contact the vibration portion 14, so that even if the piezoelectric film 12 expands and contracts and the vibration portion 14 vibrates, the electrode is not scraped. Note that, in a case where the frame-shaped member 10, the support portion 13, and the vibration portion 14 are conductive materials, an insulating material or a coating film is preferably disposed between the connection member 15 and the frame-shaped member 10, the support portion 13, and the vibration portion 14. In this case, an electrical short circuit can be prevented between the frame-shaped member 10, the support portion 13, and the vibration portion 14 and the electrode of the piezoelectric film 12.

The connection member 15 is made from, for example, metal, PET, polycarbonate (PC), polyimide, or ABS resin. The connection member 15 connects the piezoelectric film 12 and the vibration portion 14 (and the piezoelectric film 12 and the frame-shaped member 10) with an adhesive or the like. Note that connecting the connection member 15 to various components by an adhesive or the like is not essential. For example, the connection member 15 itself may be an adhesive or a double-sided tape. In this case, an adhesive or the like does not need to be prepared separately.

The piezoelectric film 12 is connected to the frame-shaped member 10 and the vibration portion 14 via the connection member 15 interposed therebetween in a state where a certain amount of tension is applied. However, this is not essential. The configuration may be such that the piezoelectric film 12 is connected so that tension is present only when the piezoelectric film 12 contracts.

The piezoelectric film 12 is deformed in the plane direction when voltage is applied. Specifically, the piezoelectric film 12 expands and contracts in the longitudinal direction thereof when voltage is applied. As the piezoelectric film 12 expands and contracts in the longitudinal direction, the vibration portion 14 vibrates in the longitudinal direction.

Figure 1C:
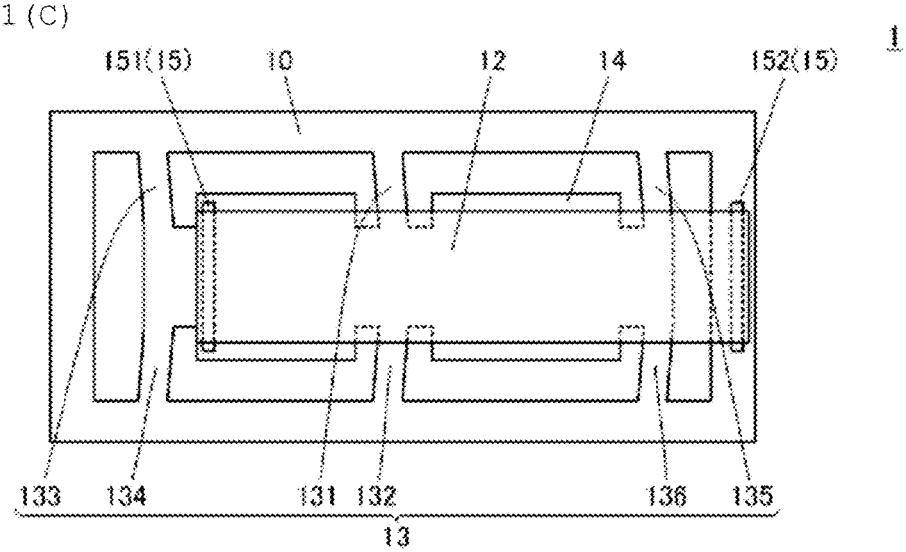
FIG. 1(C) is a plan view of the vibration structure 1.

The piezoelectric film 12 has a plane electrode formed on both main surfaces thereof. The plane electrode is connected to a drive circuit (not shown). The drive circuit expands and contracts the piezoelectric film 12 by applying voltage to the plane electrode. For example, in a case where the drive circuit applies negative voltage to the piezoelectric film 12, and the piezoelectric film 12 contracts, as shown in FIG. 1(C), the vibration portion 14 is displaced in a longitudinal direction (to the right side of the diagram). The connection member 15, which is extremely thin, transmits a force with almost no deformation. For this reason, when the piezoelectric film 12 contracts, the vibration portion 14 is easily displaced.

Further, when the drive circuit applies, for example, a positive voltage to the piezoelectric film 12, the piezoelectric film 12 expands. However, even if the piezoelectric film 12 expands, only the piezoelectric film 12 bends, and the vibration portion 14 is hardly displaced. For this reason, for example, the drive circuit mainly applies negative voltage to the piezoelectric film 12 to expand and contract the piezoelectric film 12, so as to vibrate the vibration portion 14. Note that, in a case where the piezoelectric film 12 is connected while being applied with tension, the support portion 13 which has been bent by initial tension returns to an original state and the vibration portion 14 is displaced at the time the film is stretched. Here, the piezoelectric film 12 may expand and contract when applied with negative charge, and may expand when positive charge is applied.

The application of the voltage as described above is repeatedly performed. That is, the drive circuit applies AC voltage. A driving waveform may be any waveform such as a rectangular wave, a triangular wave, a trapezoidal wave or the like. For example, when a sine wave is applied, unnecessary vibration can be reduced, and a sound generated by the unnecessary vibration can be reduced.

In the above-described vibration structure 1, the vibration portion 14 vibrates in the plane direction within the region 11 surrounded by the frame-shaped member 10. Accordingly, as shown in FIG. 1(B), the overall thickness of the vibration structure 1 is only the sum of a thickness of the piezoelectric film 12, a thickness of the connection member 15, and a thickness of the vibration portion 14 plate, and is extremely small. Further, the piezoelectric film 12 is elastic and has impact resistance. Furthermore, in a case where the frame-shaped member 10, the vibration portion 14, and the support portion 13 are formed of a single rectangular plate member of the same material, another material (with creep deterioration) such as rubber does not need to be used to support the vibration portion 14. Therefore, according to the structure of the vibration structure 1, stable vibration can be performed for a long time.

Further, since the support portion 13 is disposed close to the center of gravity 16 of the vibration portion 14 when the vibration portion 14 is viewed in the plan view, the vibration portion 14 is less likely to bend than a case where the vibration portion 14 is supported only by the third support portion 133, the fourth support portion 134, the fifth support portion 135, and the sixth support portion 136.

For this reason, when the vibration portion 14 vibrates due to expansion and contraction of the piezoelectric film 12, the bending mode, which is vibration in a direction perpendicular to the vibration direction, is unlikely to occur, and a sound accompanying the vibration is less likely to occur.

Note that the shape of the vibration portion 14 is not limited to the shape shown in FIG. 1(C). For example, the frame-shaped member 10 does not need to have an annular shape that surrounds the entire circumference in the plan view, and may have a partially open structure. Further, the frame-shaped member 10 and the vibration portion 14 do not need to be rectangular in the plan view. The frame-shaped member 10 and the vibration portion 14 may have a polygonal shape, a circular shape, an elliptical shape, or the like.

Further, the first support portion 131 and the second support portion 132 are preferably provided at locations where the bending of the vibration portion 14 is greatest when the support portions are not provided.

The support portions 13 may be provided not only in three sets and six locations, but also in seven or more locations. In that case, a primary mode is less likely to occur.

Here, in a case where the support portions are provided in six locations as in the present embodiment, generation of torsion in the vibration structure can be suppressed when an external force is applied (for example, at the time of being dropped), as compared with a case where the support portions are provided in four locations. For this reason, the deformation of the vibration structure due to plastic deformation caused by the torsion can be suppressed. Therefore, lowering a vibration characteristic of the vibration structure caused by deformation can be prevented.

Further, during assembly work of the vibration structure, when the film is fixed to the frame-shaped member in a state where the film is pulled in the longitudinal direction, and a tensile force of the film is unbalanced in a lateral direction (that is, a short direction of the film) with respect to an axis extending in the longitudinal direction of the film, torsion may be generated in the vibration portion. The torsion of the vibration portion not only causes lowering of a vibration characteristic of the vibration structure, but also leads to an increase in the thickness of the vibration structure.

In this regard, in the case where the support portions are provided in six locations as in the present embodiment, as compared with the case where the support portions are provided in four locations, the occurrence of torsion of the vibration portion can be suppressed even when a tensile force of the film is unbalanced as described above. As a result, lowering in the vibration characteristic and the increase in the thickness described above can be effectively suppressed.

Further, the third support portion 133, the fourth support portion 134, the fifth support portion 135, and the sixth support portion 136 may be connected to the short side of the vibration portion 14 instead of the long side. In this case, the support portions may be connected to a side surface of the short side of the vibration portion 14 by having a location extending in a direction perpendicular to the direction of expansion and contraction of the piezoelectric film 12 from an inner side surface of a long side portion of the frame-shaped member 10. In this case, even if the vibration structure 1 has a narrow structure, the support portion can bend in the direction in which the piezoelectric film 12 expands and contracts.

The vibration structure 1 may be provided in a housing together with a display screen unit such as a display. In this case, by combining with a touch sensor or the like, vibration can be generated in accordance with an input to a screen or the like performed by an operator.

Figure 2A:
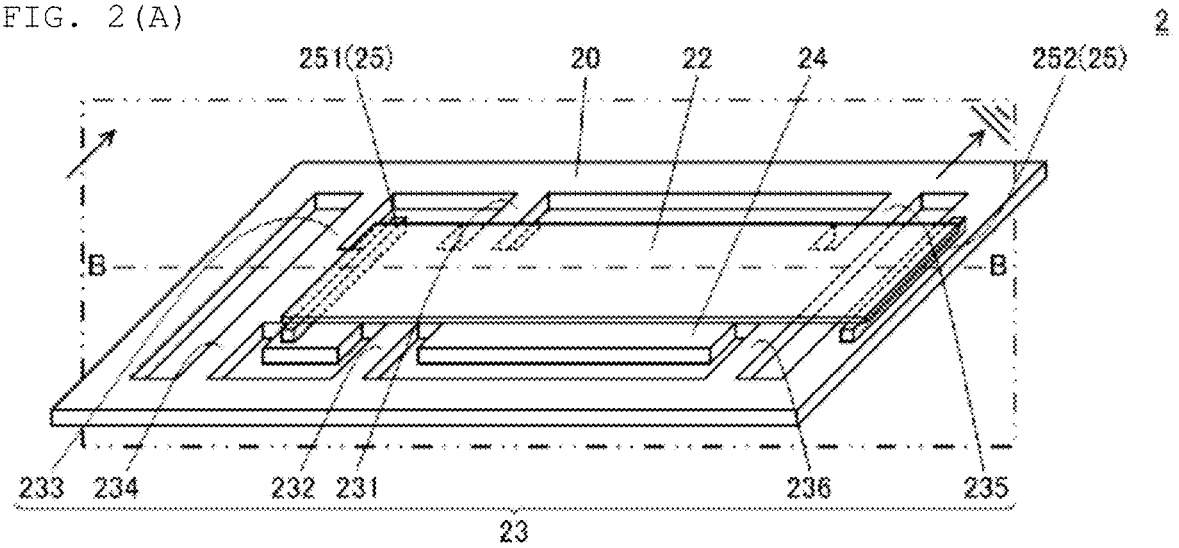
FIG. 2(A) is a perspective view of a vibration structure 2.
Figure 2B:
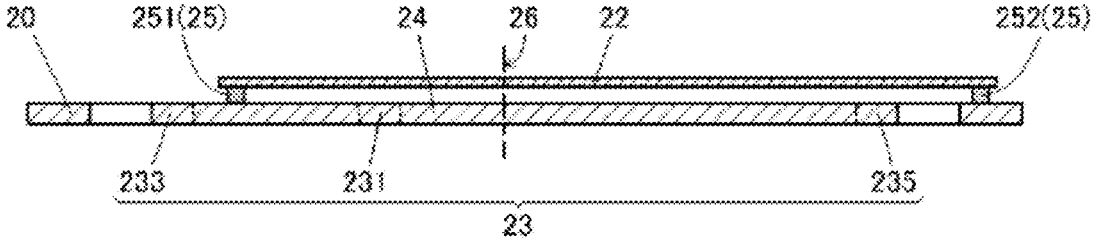
FIG. 2(B) is a cross-sectional view of the vibration structure 2 along B-B.

FIG. 2(A) is a perspective view of a vibration structure 2 according to a second embodiment of the present invention. FIG. 2(B) is a cross-sectional view of the vibration structure 2 along B-B in FIG. 2(A).

The vibration structure 2 includes a frame-shaped member 20, a piezoelectric film 22, a support portion 23 having a first support portion 231, a second support portion 232, a third support portion 233, a fourth support portion 234, a fifth support portion 235, and a sixth support portion 236, a vibration portion 24, and a connection member 25 having a first connection member 251 and a second connection member 252.

The vibration structure 2 is different from the vibration structure 1 in that the first support portion 231 and the second support portion 232 are connected to the vibration portion 24 between a center of gravity 26 of the vibration portion 24 and the first connection member 251, and the other configurations are the same. For this reason, the description of the same configurations as the vibration structure 1 is omitted.

As shown in FIG. 2(B), the second support portion 232 and the first support portion 231 facing the second support portion 232 with the vibration portion 24 interposed therebetween are disposed between the center of gravity 26 of the vibration portion 24 and the first connection member 251.

In the case where the first support portion 131 and the second support portion 132 are disposed close to the center of gravity of the vibration portion 14 as in the vibration structure 1, a bending mode (hereinafter, primary mode) that is vibration in a direction perpendicular to the direction of expansion and contraction of the piezoelectric film 12, in which both end portions in a long side direction where the third support portion 133, the fourth support portion 134, the fifth support portion 135, and the sixth support portion 136 of the vibration portion 14 are disposed are a node and a location close to the center of gravity 16 of the vibration portion 14 is an antinode is unlikely to occur.

However, since a distance between the first support portion 131 and the third support portion 133, a distance between the second support portion 132 and the fourth support portion 134, a distance between the first support portion 131 and the fifth support portion 135, and a distance between the second support portion 132 and the sixth support portion 136 are substantially the same when the vibration portion 14 is viewed in the plan view, a bending mode (hereinafter, secondary mode) that is vibration in a direction perpendicular to the direction of expansion and contraction of the piezoelectric film 12, in which both end portions of the vibration portion 14 and the first support portion 131 and the second support portion 132 are a node and an intermediate point between each of the both end portions and the first support portion 131 and the second support portion 132 is antinode, is likely to occur.

On the other hand, the first support portion 231 and the second support portion 232 of the vibration structure 2 according to the second embodiment of the present invention are disposed between the center of gravity 26 of the vibration portion 24 and the first connection member 251.

For this reason, since a distance between the first support portion 231 and the third support portion 233, and a distance between the second support portion 232 and the fourth support portion 234, a distance between the first support portion 231 and the fifth support portion 235, and a distance between the second support portion 232 and the sixth support portion 236 are different when the vibration portion 24 is viewed in the plan view, the vibration portion 24 has portions having different resonance frequencies.

Since there are portions having different resonance frequencies, occurrence of the secondary mode is suppressed in the vibration portion 24. That is, vibration in a direction perpendicular to the direction of expansion and contraction of the piezoelectric film 22 is suppressed, and a sound generated in the vibration structure 2 can be reduced.

Here, a configuration in which an even number of the support portions 23 are provided, and are disposed so as to face each other is shown; however, the present invention is not limited to the configuration, and different numbers of the support portions 23 may be provided by sandwiching the vibration portion 24, and further, the support portions 23 do not need to face each other. In that case, even if any of the support portions 23 is disposed close to the center of gravity 26 of the vibration portion 24, occurrence of the secondary mode can be suppressed.

Figure 3A:
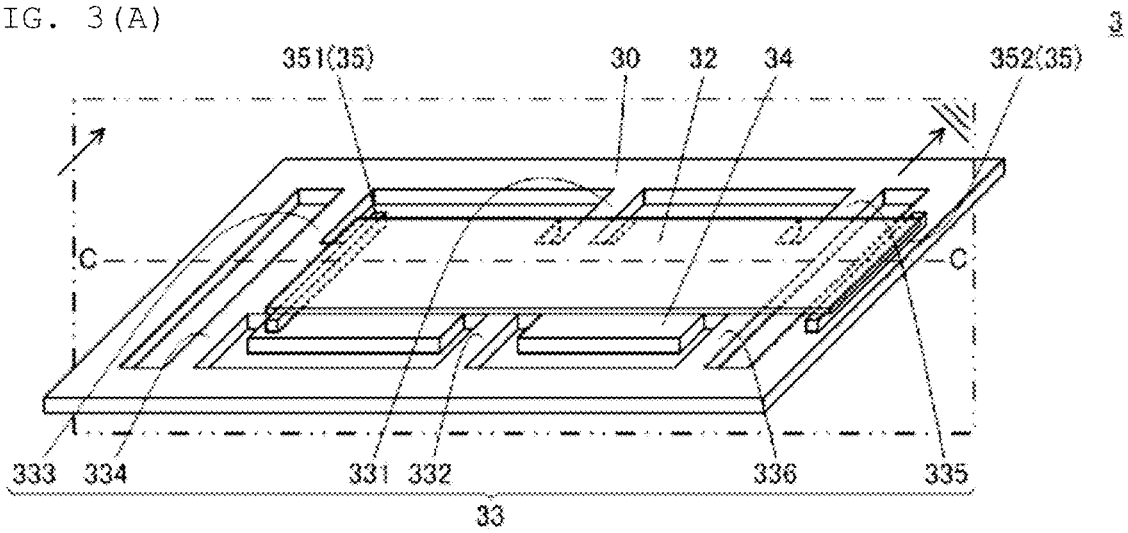
FIG. 3(A) is a perspective view of a vibration structure 3.
Figure 3B:
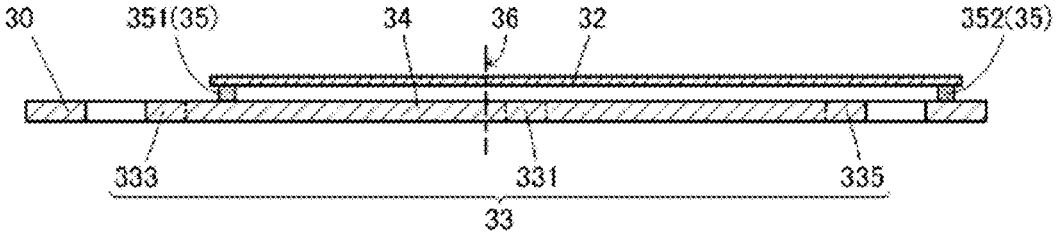
FIG. 3(B) is a cross-sectional view of the vibration structure 3 along C-C.

FIG. 3(A) is a perspective view of a vibration structure 3 according to a third embodiment of the present invention. FIG. 3(B) is a cross-sectional view of the vibration structure 3 along C-C in FIG. 3(A).

The vibration structure 3 includes a frame-shaped member 30, a piezoelectric film 32, a support portion 33 having a first support portion 331, a second support portion 332, a third support portion 333, a fourth support portion 334, a fifth support portion 335, and a sixth support portion 336, a vibration portion 34, and a connection member 35 having a first connection member 351 and a second connection member 352.

The vibration structure 3 is different from the vibration structure 2 in that the first support portion 331 and the second support portion 332 are connected to the vibration portion 34 between a center of gravity 36 of the vibration portion 34 and the second connection member 352, and the other configurations are the same. For this reason, the description of the same configurations as the vibration structure 2 is omitted.

As shown in FIG. 3(B), the second support portion 332 and the first support portion 331 facing the second support portion 332 with the vibration portion 34 interposed therebetween are disposed between the center of gravity of the vibration portion 24 and the second connection member 252.

In the vibration structure 3, the thickness of the second connection member 352 is greater than the thickness of the first connection member 351. That is, the piezoelectric film 32 and the vibration portion 34 are provided non-parallel to each other. With this configuration, when the piezoelectric film 32 expands and contracts, contact with the vibration portion 34 is suppressed.

However, in a case where, as in the vibration structure 2, the first support portion 231 and the second support portion 232 are disposed between the center of gravity 26 of the vibration portion 24 and the first connection member 251, and, as described above, the piezoelectric film 22 is inclined, the first support portion 231 and the second support portion 232 are disposed in a location closer to the inclined piezoelectric film 22, and the piezoelectric film 22 may contact with the first support portion 231 and the second support portion 232.

On the other hand, the first support portion 331 and the second support portion 332 of the vibration structure 3 according to the third embodiment of the present invention are disposed between the center of gravity 36 of the vibration portion 34 and the second connection member 352.

For this reason, as compared with the vibration structure 2 configured as described above, the first support portion 331 and the second support portion 332 are disposed at a location farther away from the inclined piezoelectric film 32, so that the possibility that the first support portion 331 and the second support portion 332 come into contact with the piezoelectric film 32 can be suppressed.

Further, since a distance between the first support portion 331 and the third support portion 333, and a distance between the second support portion 332 and the fourth support portion 334, a distance between the first support portion 331 and the fifth support portion 335, and a distance between the second support portion 332 and the sixth support portion 336 are different in the vibration structure 3, occurrence of the secondary mode can be suppressed like in the vibration structure 2.

Figure 4A:
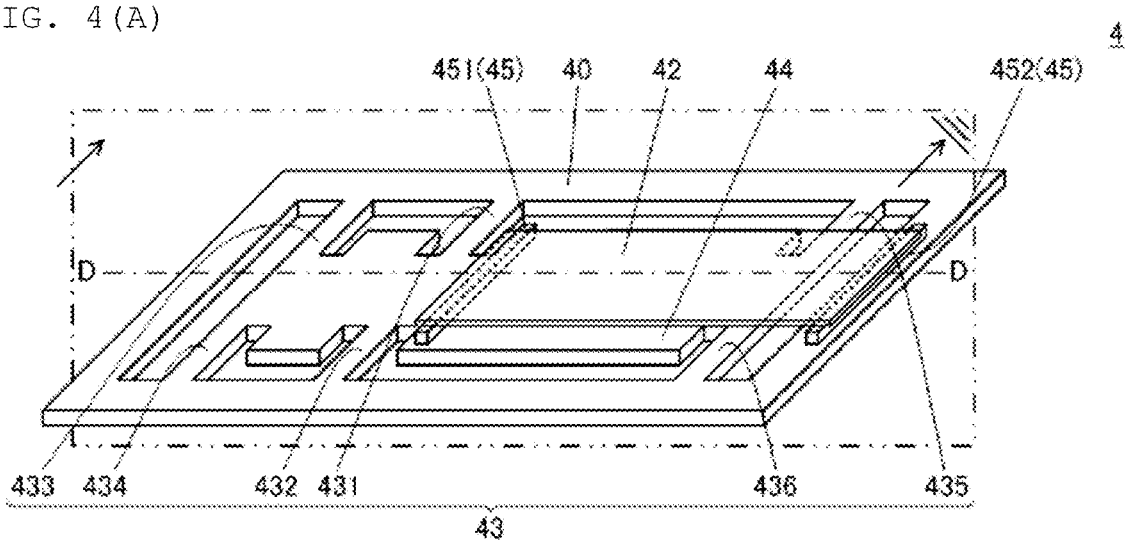
FIG. 4(A) is a perspective view of a vibration structure 4.
Figure 4B:
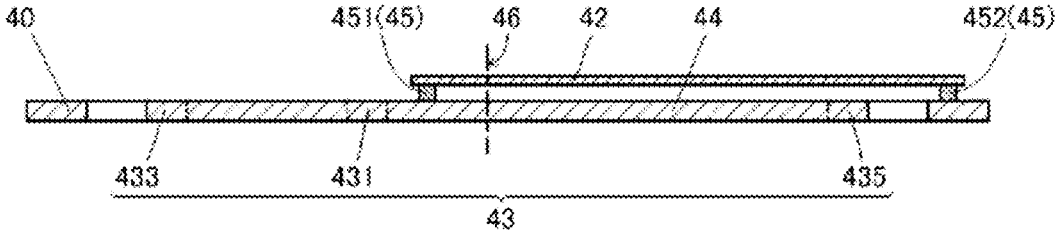
FIG. 4(B) is a cross-sectional view of the vibration structure 4 along D-D.

FIG. 4(A) is a perspective view of a vibration structure 4 according to a fourth embodiment of the present invention. FIG. 4(B) is a cross-sectional view of the vibration structure 4 along D-D in FIG. 4(A).

The vibration structure 4 includes a frame-shaped member 40, a piezoelectric film 42, a support portion 43 having a first support portion 431, a second support portion 432, a third support portion 433, a fourth support portion 434, a fifth support portion 435, and a sixth support portion 436, a vibration portion 44, and a connection member 45 having a first connection member 451 and a second connection member 452.

The vibration structure 4 is different from the vibration structure 2 in that the first connection member 451 is disposed between the first support portion 431, the second support portion 432 and the fifth support portion 435, the sixth support portion 436, and the other configurations are the same. For this reason, the description of the same configurations as the vibration structure 2 is omitted.

As shown in FIG. 4(B), the second support portion 432 and the first support portion 431 facing the second support portion 432 with the vibration portion 44 interposed therebetween are disposed between the third support portion 433 and the fourth support portion 434 and the center of gravity 46 of the vibration portion 44.

The first connection member 451 is disposed between the first support portion 431, the second support portion 432 and the fifth support portion 435, the sixth support portion 436.

According to this configuration, the piezoelectric film 42 does not overlap with the first support portion 431 and the second support portion 432 when the vibration structure 4 is viewed in the plan view.

For this reason, when the piezoelectric film 42 expands and contracts, the possibility that the piezoelectric film 42 contacts with the first support portion 431 and the second support portion 432 is suppressed more than that in the vibration structure 3.

Further, since a distance between the first support portion 431 and the third support portion 433, and a distance between the second support portion 432 and the fourth support portion 434, a distance between the first support portion 431 and the fifth support portion 435, and a distance between the second support portion 432 and the sixth support portion 436 are different like the vibration structure 2 and the vibration structure 3, occurrence of the secondary mode can be suppressed.

The characteristic configurations in the first to fourth embodiments of the present invention described above can be combined with each other without departing from the gist of the present invention.

The above-described embodiments disclosed this time are an example in all respects, and is not restrictive. The technical scope of the present invention is defined by the claims, and includes all modifications within the meaning and scope equivalent to the description of the claims.

DESCRIPTION OF REFERENCE SYMBOLS

1: Vibration structure
10: Frame-shaped member
11: Region surrounded by frame-shaped member
12: Piezoelectric film
131: First support portion
132: Second support portion
133: Third support portion
134: Fourth support portion
135: Fifth support portion
136: Sixth support portion
14: Vibration portion
151: First connection member
152: Second connection member
16: Center of gravity

The invention claimed is:

1. A vibration structure comprising:
a film constructed to deform in a plane direction as a voltage is applied thereto;
a frame-shaped member;
a vibration portion surrounded by the frame-shaped member in a plan view of the vibration structure;
a support portion connecting the vibration portion and the frame-shaped member, and supporting the vibration portion within the frame-shaped member;
a first connection member that connects the film to the frame-shaped member;
a second connection member that connects the film to the vibration portion such that the vibration portion vibrates in the plane direction when the film is deformed in the plane direction, wherein
the support portion is disposed at a position closer to a center of gravity of the vibration portion than an end portion of the vibration portion when viewed in the plan view.

2. The vibration structure according to claim 1, wherein the support portion is a first support portion, and the vibration structure further comprises:
at least a second support portion and a third support portion, wherein
the first, second, and third support portions are provided on at least one of two sides facing each other of the vibration portion that extend along the plane direction, and
lengths between adjacent support portions of the first, second, and third support portions disposed on a same one side of the two sides are different from each other.

3. The vibration structure according to claim 1, wherein the support portion is a first support portion, and the vibration structure further comprises:
a second support portion, wherein
the first and second support portions are disposed on opposed sides facing each other of the vibration portion that along the plane direction, and the first and second support portions extend in a direction different from the plane direction.

4. The vibration structure according to claim 3, further comprising:
at least a third, fourth, fifth and sixth support portion, wherein
the first, third, and fifth support portions are disposed on a first of the opposed sides facing each other of the vibration portion extending along the plane direction, and the second, fourth, and sixth support portions are disposed on a second of the opposed sides facing each other of the vibration portion extending along the plane direction,
the first, second, third, fourth, fifth, and sixth support portions extend in a direction different from the plane direction, and
lengths of sections of the vibration portion divided by adjacent support portions among the first, second, third, fourth, fifth, and sixth support portions are different on the first and/or second of the opposed sides of the vibration portion extending along the plane direction.

5. The vibration structure according to claim 1, wherein the support portion is provided at the center of gravity of the vibration portion.

6. The vibration structure according to claim 1, wherein the support portion is provided between the center of gravity of the vibration portion and the second connection member.

7. The vibration structure according to claim 1, wherein the support portion is provided between the center of gravity of the vibration portion and the first connection member.

8. The vibration structure according to claim 1, wherein the second connection member is provided between the center of gravity of the vibration portion and the support portion.

9. The vibration structure according to claim 1, wherein a main surface of the film and a main surface of the vibration portion are disposed non-parallel to each other.

10. The vibration structure according to claim 1, wherein the frame-shaped member, the vibration portion, and the support portion are formed of a same material.

11. The vibration structure according to claim 1, wherein a thickness of the first connection member and a thickness of the second connection member are different.

12. The vibration structure according to claim 1, wherein the vibration portion has regions that have different resonance frequencies and are separated by the support portion.

13. An electronic device comprising:

the vibration structure according to claim 1;

a display screen unit; and a housing enclosing the vibration structure and the display screen.

* * * * *